United States Patent [19]

Davis, Jr.

[11] 4,059,050

[45] Nov. 22, 1977

[54] CAN CRUSHER

[76] Inventor: Charles McRea Davis, Jr., 5209 Nannette St., Bonita, Calif. 92002

[21] Appl. No.: 670,855

[22] Filed: Mar. 26, 1976

[51] Int. Cl.[2] ..... B30B 3/04; B30B 9/32

[52] U.S. Cl. ..... 100/91; 100/DIG. 2; 100/173; 100/176; 100/211; 209/39; 209/213; 209/215; 302/2 R; 302/23

[58] Field of Search ..... 100/DIG. 2, 91, 215, 100/218, 211, 173, 176; 209/39, 38, 213, 215; 241/99, 60; 302/2 R, 23

[56] References Cited

U.S. PATENT DOCUMENTS

| | | | |
|---|---|---|---|
| 1,958,351 | 5/1934 | Shingshang | 209/38 |
| 3,004,721 | 10/1961 | Notzold | 241/60 X |
| 3,095,806 | 7/1963 | Mirkovich | 100/173 |
| 3,603,122 | 9/1971 | Sulzmann | 100/176 X |
| 3,687,062 | 8/1972 | Frank | 100/176 X |
| 3,776,128 | 12/1973 | Morris | 100/176 |
| 3,814,009 | 6/1974 | Davis | 100/159 |
| 3,892,658 | 7/1975 | Benowitz | 209/213 |
| 3,926,792 | 12/1975 | Buford | 209/215 |

*Primary Examiner*—Billy J. Wilhite
*Attorney, Agent, or Firm*—Brown & Martin

[57] ABSTRACT

A can crusher having a pair of vertically aligned wheels with one of the wheels having a resilient tire and the other, driven wheel being non-resilient and having outer projecting bar means that contact the resilient tire. A vertical chute directs the cans into the intersecting contact area of the rotating wheels and a second chute directs the crushed cans at the velocity imparted by the rotating wheels to contact a deflecting surface, whereby the cans are deflected at a high velocity into an air passage containing air moving therein under pressure that in turn passes through a venturi at the point of mixing with the cans, increasing the velocity of movement of the carrying air. Also the suction for the air under pressure is used to separate cans to be crushed from bottles.

9 Claims, 6 Drawing Figures

CAN CRUSHER

BACKGROUND OF THE INVENTION

The collecting and reprocessing of small cans, such as beverage containers and the like, are beneficial to society both in conserving natural resources and in improving the environment. Makers and users of such cans are particularly interested in collecting and reprocessing of the cans. However, collecting and reprocessing cans has to be done in an efficient manner in order to make it profitable to move the cans from the point of collection to the point of reusing the metal. Because of shipping rates, bulk rates and the like, it is necessary that the cans be crushed and deposited into large containers in an efficient process.

It is thus advantageous to have a high volume can crusher processor that crushes cans separated from bottles, in large volumes and moves the crushed cans through tubes to fill large movable containers that are efficiently trucked or otherwise moved and transported to the point of economically reprocessing the metal in the cans.

SUMMARY OF THE INVENTION

In an exemplary embodiment of this invention, a pair of wheels are used with one rigid wheel and the other wheel having a resilient tire. The wheels and tires are held in abutting in line relationship by a rigid frame. The frame supports the wheels through their respective axles with the outer circumferential surfaces of the wheels touching. The wheel that is non-resilient has projecting bar members that are contacted by the outer surface of the resilient tire. The non-resilient wheel is rotated by a suitable motor and drive mechanism, with the wheel functioning like a fly-wheel.

The wheels are positioned in a substantially vertical arrangement in line with a vertically positioned hopper and first chute that receives the cans and directs the cans through the chute into the intersecting contact of the wheel surfaces. The wheel surfaces crush the cans and discharges the cans at a high velocity, because of the high speed of rotation of the wheels. The projecting cans then pass downwardly through a second chute where the cans impact against an angled baffle surface that deflects the cans into an air passage discharge line, through which air is moving. The combination of the air and velocity of the deflected cans, combine to move the cans through a tube or the like into a collecting receptacle.

The deflecting plate also restricts the air passage in the mixing chamber to increase the velocity of the air at the point of contact with the deflected cans. A conveyor, conveys the cans up to the hopper in a large volume movement.

The combination of the resilient tire and the non-resilient lugged wheel, provides the crushing force to the cans and yet insures rotation of the respective wheels through a single drive wheel, without slippage between the respective wheels and without excessive tire wear. Also the lugs aid in driving the crushed cans into the intersecting contact face of the rotating wheels and also aids in crushing the cans. By driving the non-resilient wheel, this wheel functions similar to a fly wheel. Also because of the lugs, this wheel does the primary crushing of the cans. So the direct driving of the non-resilient wheel reduces slippage between the wheels, thus reducing tire wear.

It is therefore an object of this invention to provide a new and improved high volume, easily dispensing, can crusher.

In another embodiment, the air for the air passage is drawn from a connection to the upper hopper. This creates a side movement of air that draws the lighter cans to be crushed into the upper chute and into the rotating wheels. The heavier bottles drop short of the chute opening into a separate container. Thus the bottles and other heavier objects are removed from the crusher operation.

Other objects and many advantages of this invention will become more apparent upon a reading of the following detailed description and an examination of the drawings, wherein like reference numerals designate like parts throughout and in which.

Figure 1:
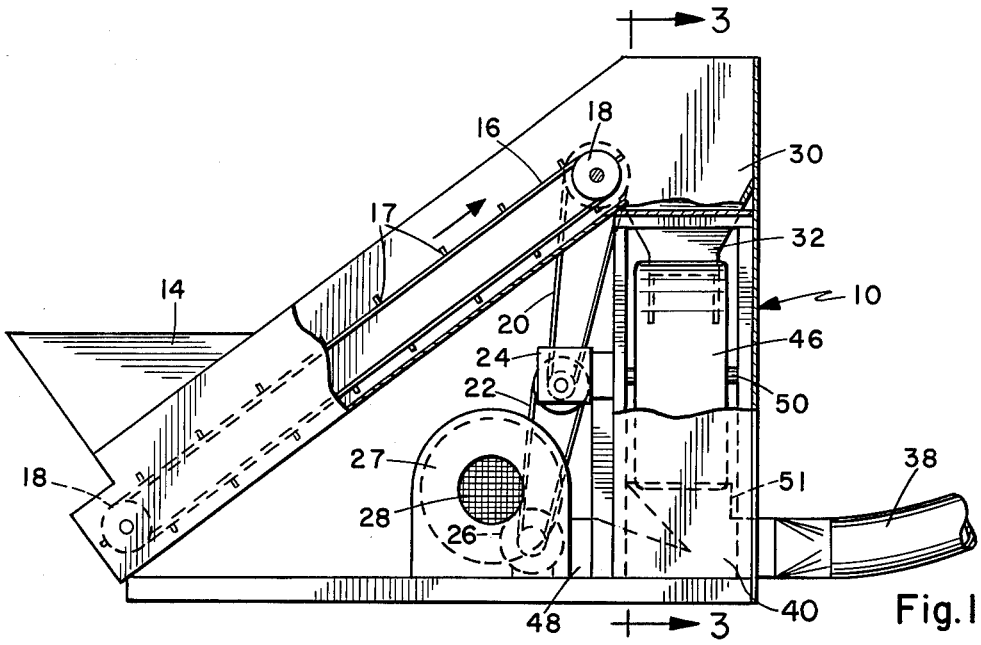
FIG. 1 is a side elevational view, partially cut away, of the can crusher.
Figure 2:
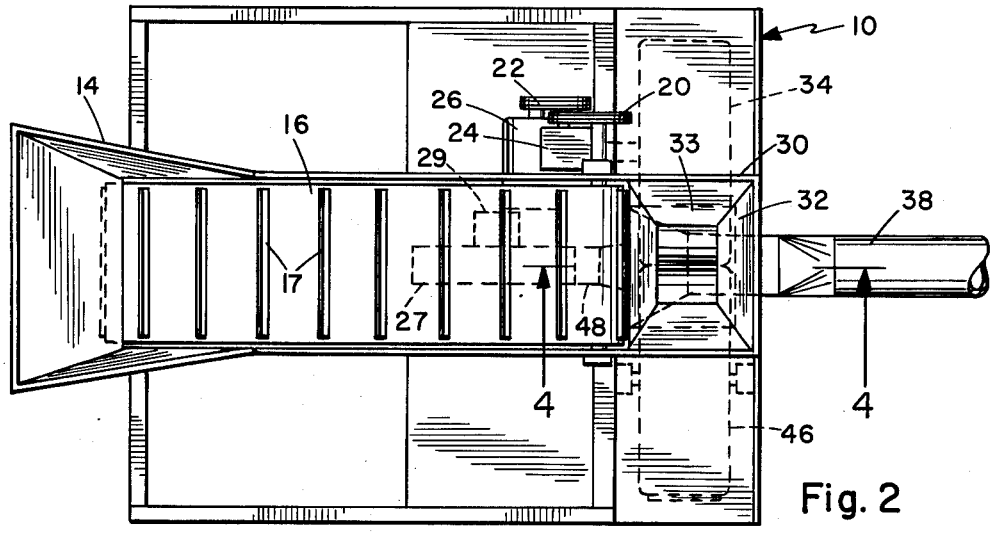
FIG. 2 is a top plan view of the can crusher.
Figure 3:
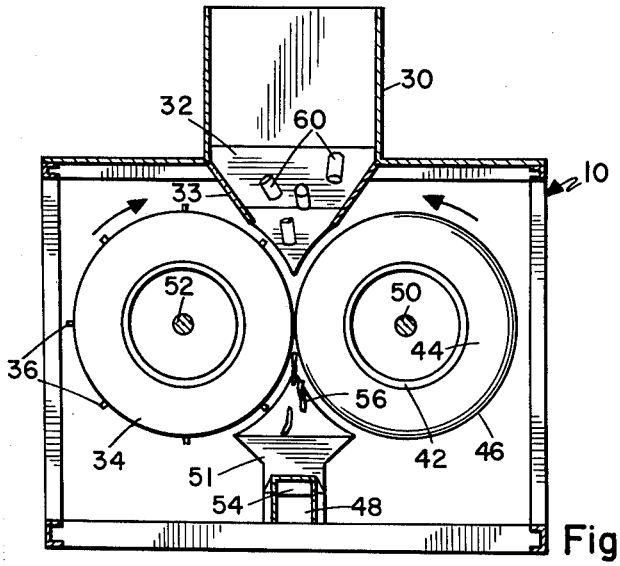
FIG. 3 is a sectional view taken on line 3—3 of FIG. 1.

Referring now to the drawings, the cans are initially dumped into a lower hopper 14. The lower hopper 14 feeds the cans onto a moving conveyor 16. Conveyor 16 comprises a known belt conveyor having bars 17 secured on the surface thereof, which belt is rotated on known rotating member 18. The rotating member 18 is driven by a belt 20 through a gear box 24, and by belt 22 that is driven by motor 26. The belt 16 moves the cans upwardly in the direction of the arrow from lower hopper 14 to the upper hopper 30. Upper hopper 30 feeds the cans into the upper chute 32 that has angled plate members 33 that position the cans for passage into the contact surface of the respective wheels 34 and 46, which are rotatably supported in a suitable frame 10.

Wheel 46 comprises a rim 42 that is secured to axle 50 and has a mounted resilient tire 44. Wheel 34 is a non-resilient wheel that is fixed to axle 52. The outer circumferential surface of wheel 34 has bar members 36. Wheel 34 is driven in rotational movement by a drive mechanism to be described hereinafter, and rotates in the clockwise direction of the arrow. The resilient tire portion of wheel 46 contacts rigid wheel 34 and is rotated in the counterclockwise direction of the arrow. With this movement, the cans 60 are pulled between the two wheels and are crushed by movement therethrough into the crushed cans 56. These crushed cans then drop through the enlarged opening of the lower chute 51. The bars 36 function both to increase the friction contact between wheel 34 and wheel 46, and also to aid in contacting and moving the respective cans 60 into and through the crushing contact of the respective wheels.

Shaft 52 of wheel 34 is rotated through a known drive mechanism or gear box 24 that is in turn rotated by belt 22 from motor 26. An air volume impeller 27, driven by a motor 29, pulls air through opening 28 and discharges the air into the mixing chamber 40. This air passes through air passage 48 and then into discharge tube 38.

Figure 4:
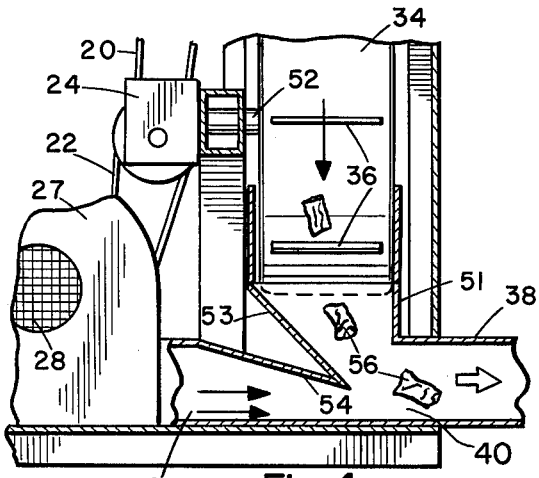
FIG. 4 is an enlarged sectional view taken on line 4—4 of FIG. 2.

The cans after being crushed are thrown at a high velocity into the lower chute passage 51. The high velocity is imparted to the cans by the speed of rotation of the wheels 46 and 34. The crushed cans 56 impact against the upper plate 53 of the V-shaped baffle that also has a lower plate 54. This angled upper baffle plate 53 deflects the cans into the direction of the arrow in tube 38, as in FIG. 4. The lower baffle 54 projects into the air passage 48 reducing its cross-sectional volume and thus creates a venturi effect that increases the velocity of the air passing therethrough at the point of contact in the mixing chamber 40 with the crushed cans 56. Thus, the air pressure plus the velocity of the cans, combine to move the cans through the conduit 38 into a large receptacle, trailer or the like (not shown).

It may also be understood, that the air moving through passage 48 also creates a movement of air downwardly through the lower chute passage 51 that further causes downward movement of the crushed cans 56 into the discharge tube 38.

Thus the system is capable of moving large amounts of cans at a relatively high velocity and rate through tube 38 to selectively fill containers.

Figure 5:
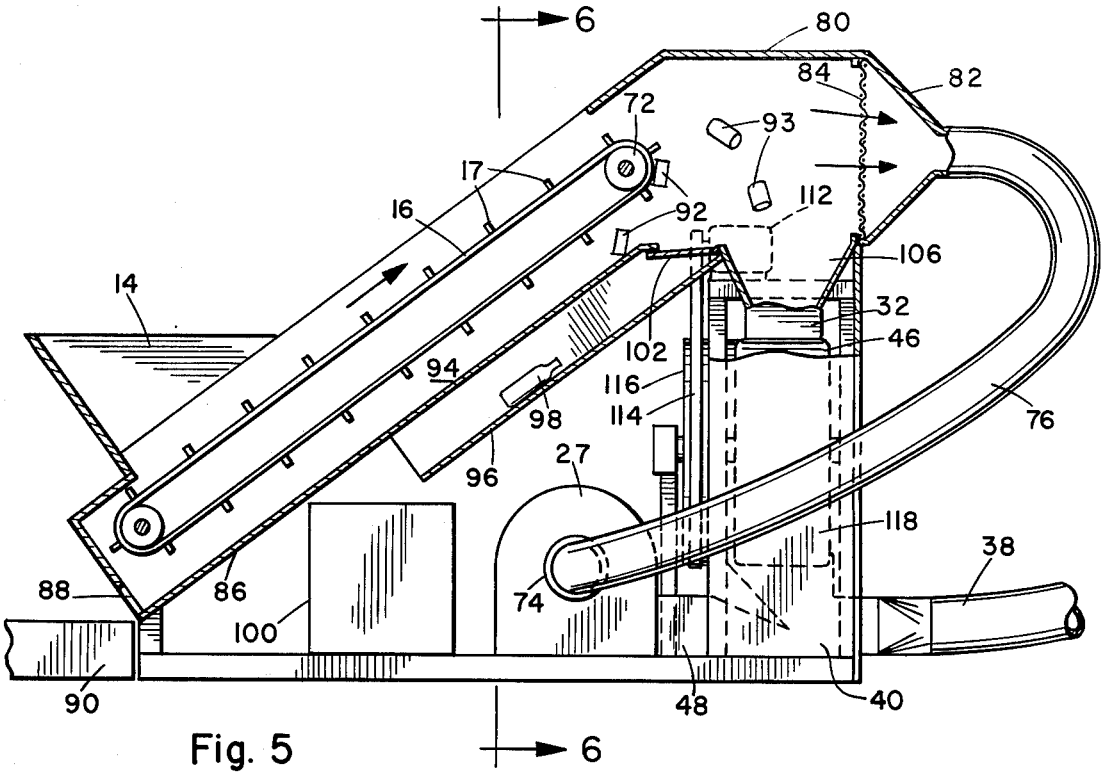
FIG. 5 is a view similar to FIG. 1, showing an alternative can and bottle sorting arrangement.
Figure 6:
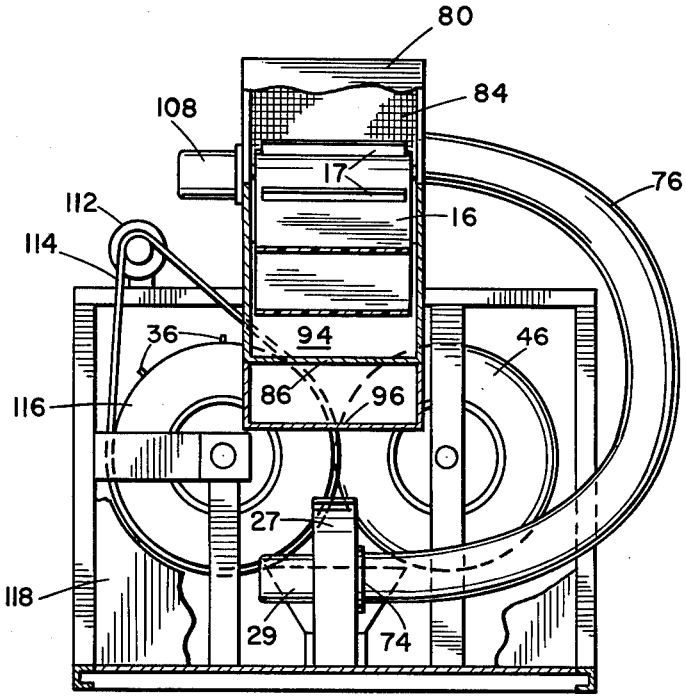
FIG. 6 is a sectional view taken on line 6—6 of FIG. 5.

In a modified embodiment, see FIGS. 5 and 6, a system is provided that is capable of separating steel cans and bottles from aluminum cans that are crushed and delivered to the containers. In this embodiment, the combination of articles are dumped into hopper 14 and carried by conveyor 16 upward into the enclosed hopper 80. In this movement, a known magnetic drum 72 is used to drive the conveyor belt 16. The steelcans are held by the magnetic drum 72 in continuous movement of the belt around drum 72 until the belt 16 separates from the drum 72, wherein the steel cans 92 then slide down chute 94 along wall 86 and out opening 88 into the receptacle 90. Blower 27 draws air through suction opening 74, tube 76 and funnel 82 into the hopper 80. This movement of air pulls the lighter weight aluminum cans 93 into the entry 106 of the upper chute 32. The bottles 98, being heavier than the cans 93, are not so pulled by the air movement and drop through trap door 102 and move down chute 96 into the container 100. The screen 84 prevents large particles from being drawn by the air suction through tube 76 into the blower 27.

Also in this embodiment, the non-resilient wheel 116 is not driven by the previously described drive mechanism, but rather is driven by a separate motor 112 and a drive belt 114. The wheel 116 has a width approximately twice that of the tire 46, and the extra width is smooth and does not have cross bars 36 thereon. The belt 114 is positioned on this smooth surface. Also the conveyor system is driven by a direct motor 108 to the drive drum 72.

Wheel 116 is heavier than the tire wheel 46 and operates as a fly wheel. Further wheel 116, with lugs 36, does the primary work in moving the cans into the space between the wheels and in driving the cans through that space. Thus the non-resilient wheel carries the greatest load and is subject to the greatest amount of slippage. Since this wheel is the one that is driven, there is little or no slippage between wheel 116 and tire 46, and thus wear on tire 46 is greatly reduced.

The entire housing 118 is enclosed so that the air drawn through screen 84 primarily passes through the spaces on the open side of the chute 80 opposite screen 84. This provides the maximum movement of air in the direction of moving cans 93 to enter into the chute 32. Little or no air is drawn through chute 32 in the opposite direction because of the closeness of positioning of the wheels 116 and 46 in the enclosed chamber 118.

Having described my invention, I now claim.

1. A can crusher comprising:

a pair of wheels with one of said wheels having a resilient tire and the other wheel being non-resilient, frame means for holding said wheels in abutting alignment with the outer circumferential surfaces touching, said frame means including axles for supporting said wheels for relatively in line rotational movement, motor means for rotating one of said wheels, chute means for directing cans to be crushed into the intersecting contact of said wheels, and said non-resilient wheel having outer projecting means on the outer surface thereof for being contacted by the outer circumferential surface of the resilient tire.

2. A can crusher comprising:

a pair of wheels with at least one wheel having a resilient tire, frame means for holding said wheels on axles in vertical orientation in abutting alignment for rotational contact, means for rotating at least one of said wheels, first chute means for directing cans to be crushed into the intersecting contact of said wheels, second chute means below said wheels for receiving the crushed cans, a discharge tube in communication with said second chute for discharging crushed cans, air passage means below and communicating with said second chute means for receiving said cans and carrying said cans to and through said discharge tube, means for supplying air under pressure to said air passage means, said one of said wheels being non-resilient, and said non-resilient wheel having cross bar means on its outer surface for contacting and driving the resilient tire of the other wheel.

3. A can crusher comprising:

a pair of wheels with at least one wheel having a resilient tire, frame means for holding said wheels on axles in vertical orientation in abutting alignment for rotational contact, means for rotating at least one of said wheels, first chute means for directing cans to be crushed into the intersecting contact of said wheels, second chute means below said wheels for receiving the crushed cans, a discharge tube in communication with said second chute for discharging crushed cans, air passage means below and communicating with said second chute means for receiving said cans and carrying said cans to and through said discharge tube, means for supplying air under pressure to said air passage means, said second chute means and said air passage means intersecting in a mixing chamber, said mixing chamber having a projecting baffle that projects into said second chute means and into air passage means, restricting each of the respective passages.

4. A can crusher as claimed in claim 3 wherein:

said projecting baffle comprising a V-shaped member that projects from the side adjacent the source means for air to said air passage means, and the upper baffle surface projecting into said second chute means at an angle for deflecting downwardly moving cans through the mixing chamber and into said air passage in the direction of movement of the air.

5. A can crusher as claimed in claim 4 wherein:

said V-shaped baffle restricting the volume of the air passage means creating a venturi that increases the velocity of the passing air at the point of receiving the crushed cans.

6. A can crusher comprising:

a pair of wheels with at least one wheel having a resilient tire, frame means for holding said wheels on axles in vertical orientation in abutting alignment for rotational contact, means for rotating at least one of said wheels, first chute means for directing cans to be crushed into the intersecting contact of said wheels, second chute means below said wheels for receiving the crushed cans, a discharge tube in communication with said second chute for discharging crushed cans, air passage means below and communicating with said second chute means for receiving said cans and carrying said cans to and through said discharge tube, and means for supplying air under pressure to said air passage means.

conveyor means for conveying aluminum cans, steel cans, bottles and other objects to the first chute means, the input end of said first chute means being substantially enclosed by an enclosed housing forming an upper hopper, and means for drawing air across the conveyor means and said upper hopper and across said input first chute means pulling aluminum cans from the upper discharge end of the conveyor into a position over and then into said first chute means.

7. A can crusher as claimed in claim 6 including:

receptacle means positioned under the upper end of the conveyor wherein bottles, being heavier than aluminum cans, fall short of the chute means and enter a bottle chute that directs the bottles into a separate container.

8. A can crusher as claimed in claim 7 in which:

said conveyor means comprising a continuous belt that is rotated around an upper magnetic drum, and said magnetic drum adhering to steel cans pulling the steel cans around the drum where the belt separates the cans from the drum, which steel cans fall through a chute into a separate receptacle.

9. A can crusher as claimed in claim 8 including:

a line extending from the drawing air side of said upper hopper to said air supply means, whereby said air supply is obtained by drawing air through said line on said upper hopper.

* * * * *